US008336378B2

(12) United States Patent
Altinier et al.

(10) Patent No.: US 8,336,378 B2
(45) Date of Patent: Dec. 25, 2012

(54) METHOD FOR ESTIMATING THE MOMENT OF INERTIA OF THE ROTATING UNIT OF A WASHING MACHINE, AND WASHING MACHINE IMPLEMENTING SAID METHOD

(75) Inventors: Fabio Altinier, Codogne (IT); Terenzio Girotto, Sesto Al Reghena (IT); Marco Giovagnoni, Udine (IT)

(73) Assignee: Electrolux Home Products Corporation N.V., Raketstraat (BE)

( * ) Notice: Subject to any disclaimer, the term of this patent is extended or adjusted under 35 U.S.C. 154(b) by 315 days.

(21) Appl. No.: 12/935,515

(22) PCT Filed: Mar. 27, 2009

(86) PCT No.: PCT/EP2009/002245

§ 371 (c)(1),
(2), (4) Date: Sep. 29, 2010

(87) PCT Pub. No.: WO2009/121524

PCT Pub. Date: Oct. 8, 2009

(65) Prior Publication Data

US 2011/0023602 A1 Feb. 3, 2011

(30) Foreign Application Priority Data

Mar. 31, 2008 (EP) ..... 08153788

(51) Int. Cl.
*G01M 1/16* (2006.01)

(52) U.S. Cl. ..... 73/460; 73/65.07; 73/65.01; 73/504.13

(58) Field of Classification Search ..... 73/460
See application file for complete search history.

(56) References Cited

U.S. PATENT DOCUMENTS 7,748,067 B2 * 7/2010 Altinier et al. ..... 8/158

FOREIGN PATENT DOCUMENTS

| | | |
|---|---|---|
| EP | 345120 A1 * | 12/1989 |
| EP | 1 447 469 | 8/2004 |
| EP | 1 609 901 | 12/2005 |

OTHER PUBLICATIONS

Machine Translation of EP345120 A1, Publisher: European Patent Office, Date Translated: Oct. 5, 2012, pp. 15.*
Jul. 1, 2009 International Search Report issued in corresponding PCT/EP2009/002245.

* cited by examiner

*Primary Examiner* — Lisa Caputo
*Assistant Examiner* — Roger Hernandez-Prewitt
(74) *Attorney, Agent, or Firm* — Banner & Witcoff, Ltd

(57) ABSTRACT

A method for estimating the moment of inertia of a rotating unit of a washing or washing-and-drying machine comprising the steps of: establishing one or more linear parameters; rotating the drum of the rotating unit in such a way as to reach a set of speeds of a pre-set value; once each speed of a pre-set value is reached, detecting the value of the torque provided to the rotating unit; and finally estimating the moment of inertia of the rotating unit through a linear combination of the torques detected and by means of the linear parameters.

25 Claims, 3 Drawing Sheets

METHOD FOR ESTIMATING THE MOMENT OF INERTIA OF THE ROTATING UNIT OF A WASHING MACHINE, AND WASHING MACHINE IMPLEMENTING SAID METHOD

BACKGROUND OF THE INVENTION

The present invention relates to a method for estimating the moment of inertia of the rotating unit of a washing machine, and to a washing machine implementing said method.

In particular, the present invention relates to a method that is able to estimate the moment of inertia in a washing machine or in a washing-and-drying machine of the type comprising: a box-like frame, and a washing unit set within the frame and comprising a tub fixed within the frame by means of a suspension equipment and a rotating unit, which is, in turn, provided with a laundry drum housed in an axially rotatable way within the tub, and a driving device able to set the laundry drum in rotation about its longitudinal axis inside the tub itself.

Methods are known that are able to determine the unbalancing of the washing unit of a washing machine in order to control the speed of rotation of the laundry drum so as to prevent possible conditions of collision of the washing unit with the frame and at the same time reduce vibrations and/or phenomena of bouncing of the washing machine caused by said unbalancing.

Some of the aforesaid methods determine the unbalancing of the washing unit through calculation of the moment of inertia of the "total rotating load" associated to the mass of the rotating unit plus the mass of the laundry housed inside the laundry drum.

In particular, the aforesaid methods calculate the moment of inertia via an energy-balance function, which necessarily requires both a measurement of the torque and a measurement of the speed of rotation of the laundry drum in a condition of "stability" of the rotating unit, which is reached only when, thanks to the centrifugal force, the laundry is substantially stuck to the internal wall of the laundry drum in a state of immobility.

If the energy-balance function used in the aforesaid methods on the one hand enables precise calculation of the moment of inertia of the rotating unit plus the laundry contained in the drum, on the other hand it is constrained to a condition of "stability" of the rotating unit being reached, which occurs when the speed of rotation of the washing drum reaches the so-called "sticking speed", which, as is known, is the minimum speed of rotation of the drum at which the laundry remains completely stuck to the wall of the drum.

The sticking speed referred to above can reach relatively high values and consequently, in the case of non-uniform distribution of the laundry inside the drum, can determine an uncontrolled unbalancing of the rotating unit so causing a collision of the washing unit with the frame.

There consequently exists, on the one hand, the need to eliminate the risk of collision of the washing unit with the frame in any condition of operation of the washing machine and, on the other hand, the need to have available an estimate of the moment of inertia of the rotating unit plus laundry present in the laundry drum even when the speed of rotation is maintained around small values, i.e., lower than the sticking speed.

SUMMARY OF SELECTED INVENTIVE ASPECTS

The aim of the present invention is consequently to provide a method that will be able to estimate the moment of inertia even at speeds lower than the aforesaid sticking speed in such a way as to be able to maintain control of unbalancing at any speed, hence eliminating any condition of collision between the washing unit and the frame of the washing machine.

According to an aspect of the present invention, provided is a method for estimating the moment of inertia of the rotating unit of a washing machine, as specified in claim 1 and preferably, but not necessarily, in anyone of the claims depending either directly or indirectly upon claim 1.

According to another aspect of the present invention, a device for estimating the moment of inertia of the rotating unit of a washing machine is provided as specified in claim 9 and preferably, but not necessarily, in anyone of the claims depending either directly or indirectly upon claim 9.

According to yet another aspect of the present invention, provided is a computer readable data storage medium containing instructions as specified in claim 17.

According to a further aspect of the present invention, provided is a washing machine as specified in claim 18 and preferably, but not necessarily, in anyone of the claims depending either directly or indirectly upon claim 18.

BRIEF DESCRIPTION OF THE DRAWINGS

The present invention will now be described with reference to the accompanying drawings, which illustrate a non-limiting example of an embodiment thereof and in which.

DETAILED DESCRIPTION OF EXAMPLE EMBODIMENTS

Figure 1:
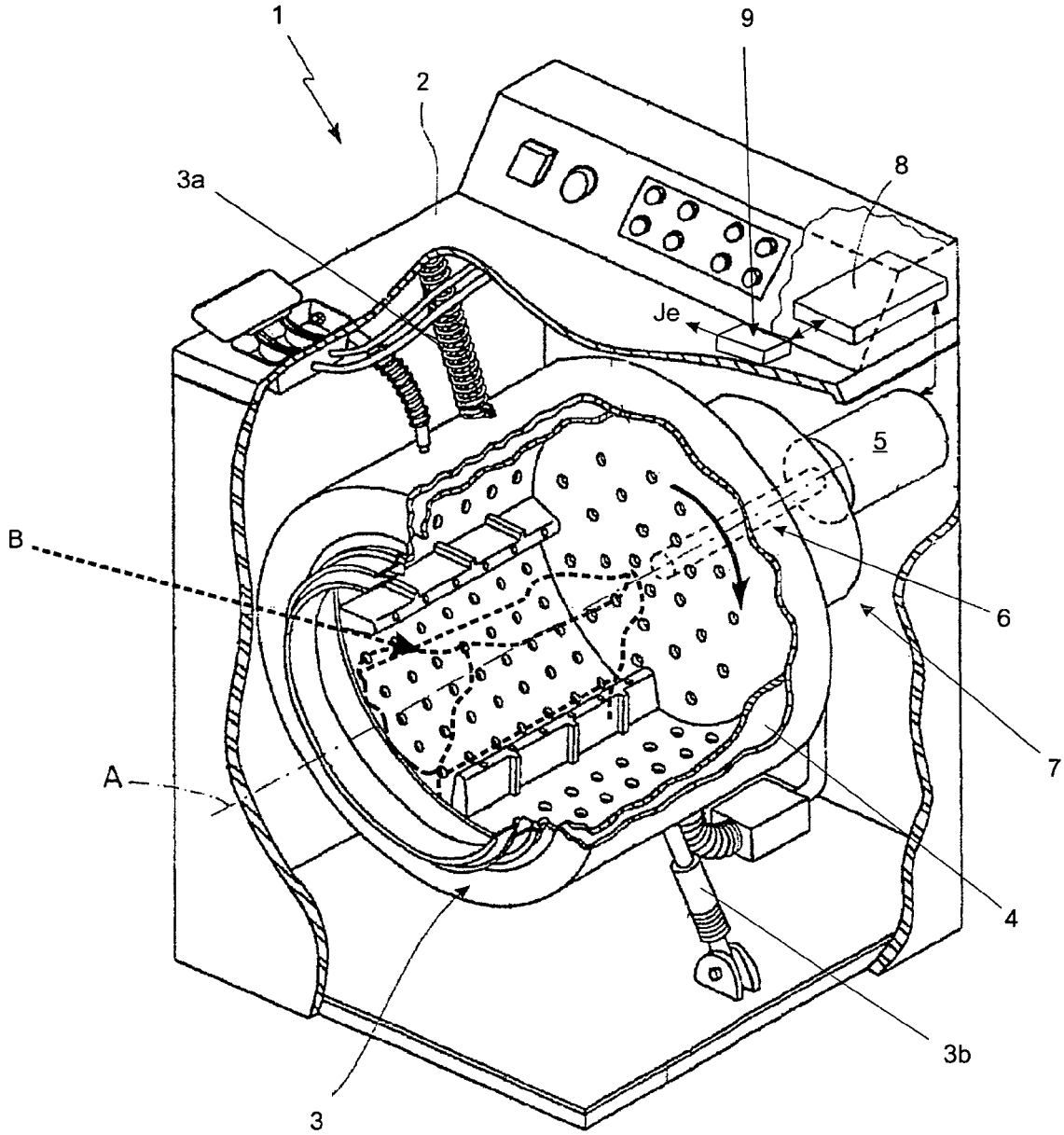
FIG. 1 illustrates in perspective view, with parts in cross section and parts removed for clarity, a washing machine provided according to the teachings of the present invention.

With reference to FIG. 1, number 1 designates as a whole a washing machine or a washing-and-drying machine for house-hold use, which basically comprises: an outer box-like frame 2; and a washing unit 3 connected to the frame 2 through suspension devices 3*a* and damping devices 3*b*, and in turn comprising a laundry drum 4, which is designed to house the laundry B to be washed and is mounted within the box-like frame 2 so that it is free to rotate about an axis of rotation A of its own, and is set directly facing an opening made in the frame 2 for loading and unloading the laundry.

The electrical household appliance 1 further comprises a motor unit, such as, for example, an electric motor 5, which is connected to the laundry drum 4 through a drive member 6 for transmitting the motion for driving the laundry drum 4 in rotation about its axis of rotation A.

The laundry drum 4, the drive member 6, and the rotor of the electric motor 5 together define a rotating unit 7 of the washing machine 1.

The washing machine 1 further comprises a control unit 8, designed to govern the electric motor 5, and a calculation device 9, which is designed to estimate the total moment of inertia Je of the rotating unit 7 plus the laundry contained inside the drum 4.

In the case in point, in the example shown in FIG. 3, the calculation device 9 comprises a memory module 10, stored inside which is a series of linear parameters Ki(ωi) (described in detail hereinafter), and an estimator module 11, which receives at input the torque values Ti(ωi) provided to the rotating unit 7 by the motor 5, and supplies at output the moment of inertia Je determined as a function of the torque values Ti(ωi) itself.

In detail, the estimator module 11 calculates the moment of inertia Je through a linear combination FL(Ki(ωi),Ti(ωi)) comprising one or more torque values Ti(ωi) multiplied by respective pre-set linear parameters Ki(ωi), and in which each torque value Ti(ωi) is measured at a pre-set speed ωi lower than a sticking speed ωa.

Figure 3:
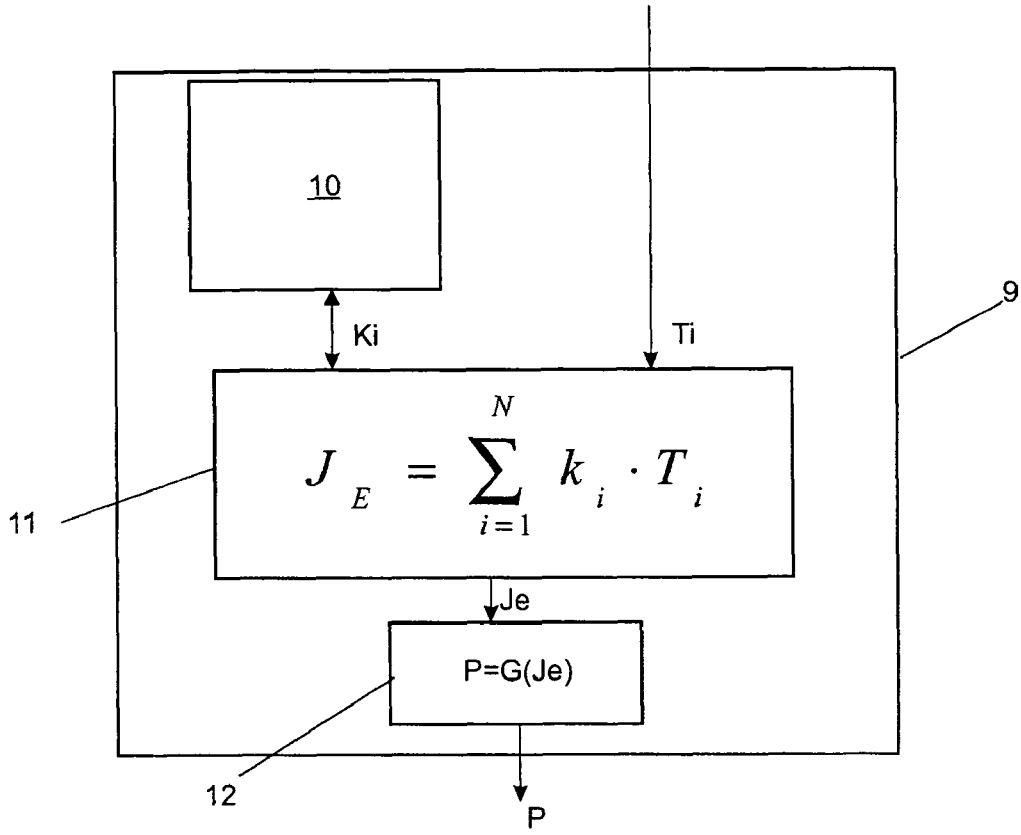
FIG. 3 is a schematic illustration of the device for estimating the moment of inertia of the rotating unit plus laundry present in the laundry drum, in the washing machine shown in FIG. 1.

In particular, in the example illustrated in FIG. 3, the moment of inertia Je is calculated through a linear combination FL(Ki(ωi), Ti(ωi))=ΣKi(ωi)*Ti(ωi) comprising preferably, but not necessarily seven linear parameters and six torque values Ti determined at six respective different speeds ωi preferably, but not necessarily alternated in opposite directions:

$$Je=FL(Ki(\omega i),Ti(\omega i)); \text{ i.e.}$$

$$Je=Ko+K1(\omega 1)*T1(\omega 1)+K2(\omega 2)*T2(\omega 2)+K3(\omega 3)*T3(\omega 3)+K4(\omega 4)*T4(\omega 4)+K5(\omega 5)T5(\omega 5)+K6(\omega 6)*T6(\omega 6)$$

The linear parameters Ki(ωi) can be estimated experimentally through laboratory tests in which there are measured the real inertia and the torque values Ti provided to the rotating unit 7 in pre-set conditions of speed ωi. The calibration of the parameters is done collecting data with different laundry loads (starting from the minimum up to the maximum load) and performing several test cycles with the specific speed profile selected for the machine under analysis.

In the case in point, it is possible to determine the linear parameters Ki(ωi) through an estimation method, preferably, but not necessarily, the least-squares method. The least-squares method is a known optimization technique, which enables a linear combination of specific functions to be found that, by means of linear parameters, approaches as closely as possible an interpolation of a set of data, which, in this case, are constituted by the torque values Ti(ωi) measured at the various speeds ωi.

Figure 2:
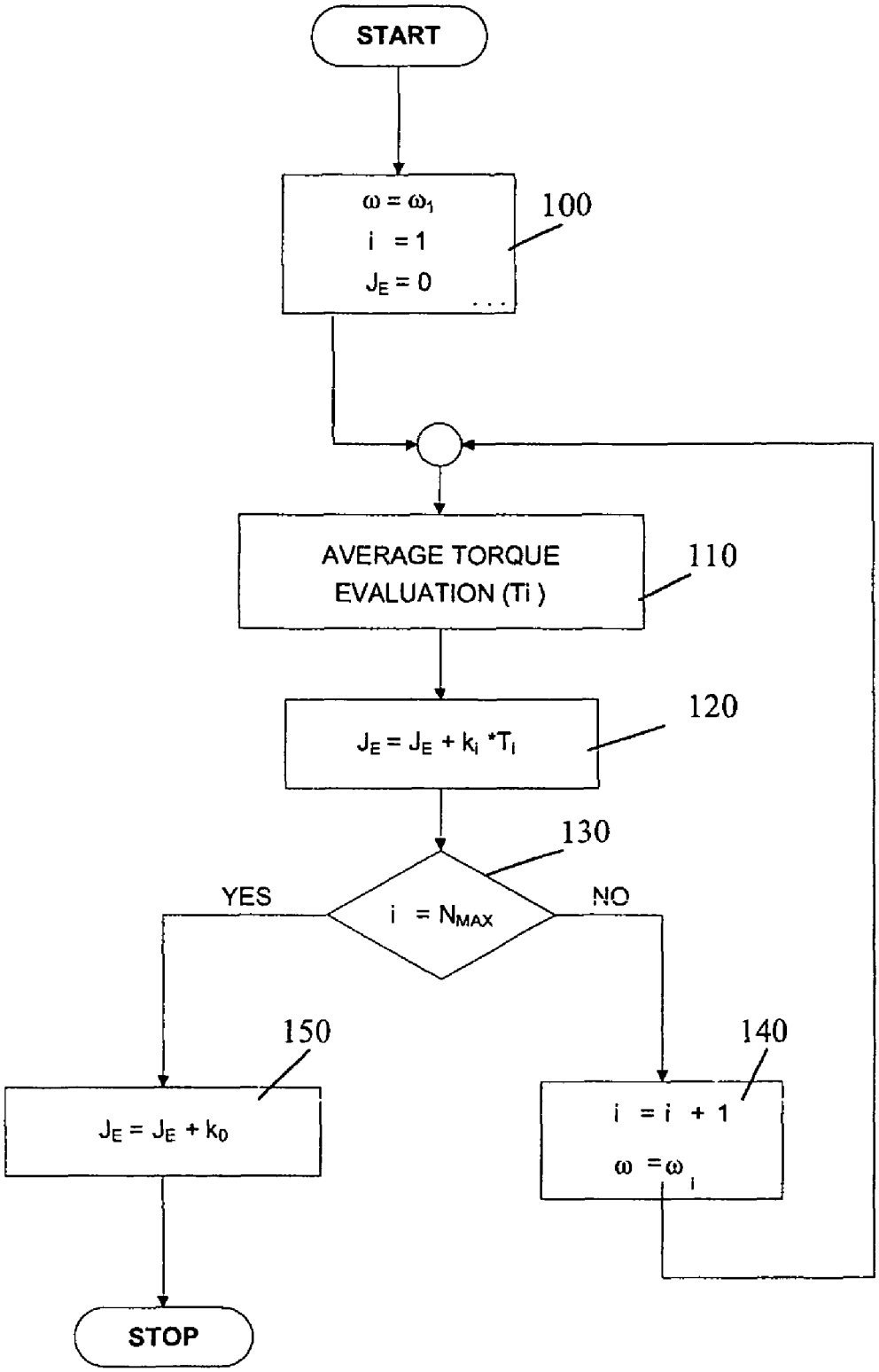
FIG. 2 is a schematic view of a flowchart indicating the operations implemented by the method for estimating the moment of inertia of the washing machine illustrated in FIG. 1.
Figure 4:
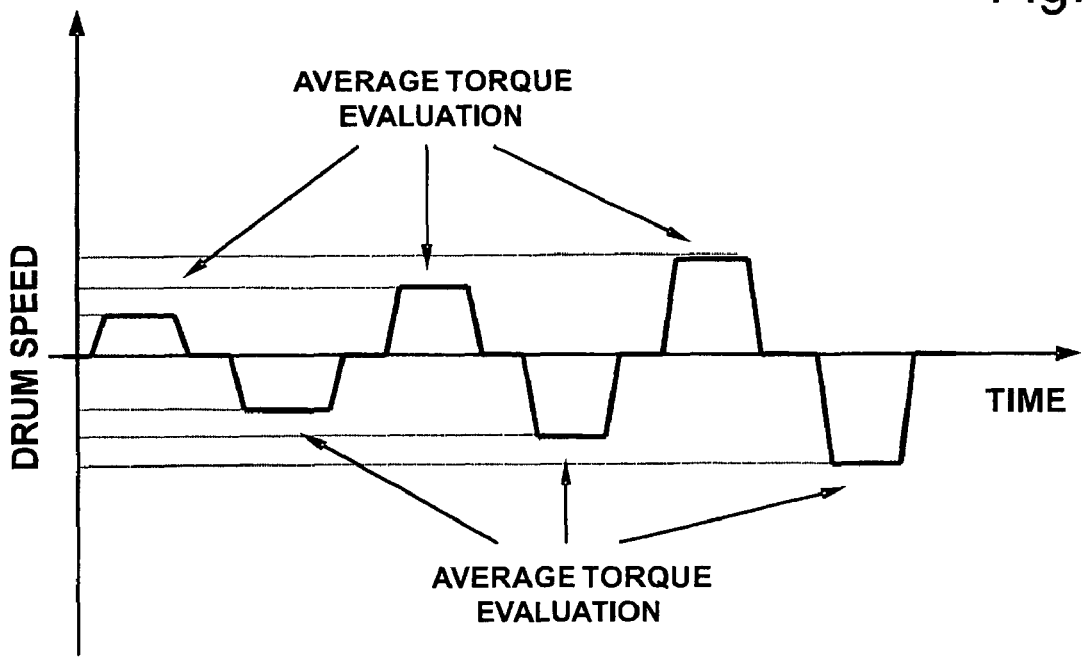
FIG. 4 illustrates an example of detection of the torque provided to the rotating unit over a pre-set speed profile of rotation imposed to the drum of the washing machine.

With reference to FIGS. 2 and 4, the method for estimating the total moment of inertia Je of the rotating unit 7 plus the laundry B contained inside the laundry drum 4 will be described in what follows.

It should be pointed out that the present invention is related to a low speed measuring procedure to evaluate an approximated value of the inertia without reaching the sticking speed. A speed profile used for the inertia estimation is showed in the FIG. 4. The profile is composed of some steps at different speeds that are preferably, but not necessarily performed in a different direction (in the figure there are six steps at constant speed, three CW and three CCW). Over each step at low speed the total motor torque is carried out. The total motor torque is mainly the contribution of two terms: the friction torque Ta (approximately constant) and the lifting torque Ts (the portion required to lift the freely moving part of the laundry load). The lifting torque Ts is related to the laundry amount: larger is the laundry load and higher is the lifting torque Ts at a specific speed. Therefore, an appropriate combination of the torque values coming from each step provides a good approximation of the inertia of the rotating unit plus the laundry present in the laundry drum. The number of steps and speeds involved in the procedure could be preferably, but not necessarily different for machines with different washing units. Generally, more steps mean higher precision in the inertia estimation. Generally the torque values are measured with clothes completely wet but the procedure can be useful also for measuring the inertia when the clothes are still dry.

With reference to FIGS. 2 and 4 in the initial step, the speed of the drum 4 reaches a pre-set value ω=ω1, and a counter i and the moment of inertia Je are initialized by setting i=1 and Je=0, respectively (block 100).

In this step, the calculation device 9 measures the total torque T1(ω1) (block 110), and then (block 120) the temporary value of the moment of inertia Je is updates by adding the value K1(ω1)*T1(ω1), thus implementing the following relation:

$$Je=Je+K1(\omega 1)*T1(\omega 1)$$

At this point, a check is made to see whether the counter i has reached its maximum value Nmax (i=Nmax) (block 130), corresponding to the maximum number of terms envisaged by the linear combination FL(Ki,Ti(ωi)) and, if it has not reached said value (output NO from block 130), the counter is incremented (i=i+1) and at the same time the speed is varied, i.e., ω=ωi (block 140).

Once the speed ω=ωi is reached, the method envisages measuring the total torque Ti(ωi) (block 110), and then (block 120) updating again the temporary value Je by adding the value Ki(ωi)*Ti(ωi) via the relation:

$$Je=Je+Ki(\omega i)*Ti(\omega i)$$

If, instead, the counter has reached its maximum value i=Nmax (output YES from block 130), the method provides the final value of the moment of inertia Je by adding the pre-set constant. K0 correlated to the friction torque of the rotating unit 7.

The method explained above estimates therefore the moment of inertia Je by measuring the torque values Ti provided by the motor over some steps performed at substantially constant speed for a certain time interval.

In general, the method for estimating the moment of inertia Je measures and elaborates the torque values Ti provided to the rotating unit and drives the motor 5 in such a way to generate a stepwise pattern of pre-determined speeds, or else a ramp of speed.

It should moreover be pointed out that the measurements of torque can be performed by rotating the drum alternately in opposite directions at pre-set speeds ωi, as shown in the example of FIG. 4.

It should moreover be pointed out that, in the case where the sticking speed ωa has a value higher than approximately 75 rpm, the pre-set measurement speeds ωi of the aforesaid method can be conveniently comprised in a range of approximately 45-70 rpm.

The calculation device 9 further comprises an estimation module 12, which receives at input the moment of inertia Je and supplies at output an estimate of the weight of the laundry B contained in the drum. In the case in point, the estimation module 12 can implement a function P=G(Je), determined, for example at an experimental stage, which enables unique determination, for each value of the moment of inertia Je, of a corresponding weight P of the laundry contained in the drum 4. Said function can correspond, for example, to a curve (not indicated) obtained experimentally via laboratory tests indicating the evolution of the moment of inertia Je as the weight P of the laundry B varies.

Estimation of the moment of inertia Je is performed on the basis of the measurement of a series of torques Ti, the main component of which is the lifting torque Ts.

As above disclosed the aforesaid estimation of the moment of inertia Je is substantially based upon the fact that, in conditions of low speed, i.e., lower than the sticking speed ωa, the measured torque Ti basically comprises two components, i.e., the lifting torque Ts deriving from the action of lifting of the laundry, which, since it is not stuck to the wall, tends to shift by gravity towards the bottom part of the drum 4, and a friction torque Ta correlated to the friction encountered by the rotating unit 7.

Laboratory tests have, in fact, shown that at low speeds, i.e., in conditions of non-sticking of the laundry, the lifting torque Ts has a relevant effect in comparison with the friction torque.

In the case in point, laboratory tests have shown that, if a mass present inside the drum is completely stuck into over the pre-set speed profile (for example when the drum speed is higher then the sticking speed or when some fixed masses is used for simulating an increase in the drum inertia), the aforesaid method estimates a moment of inertia Je substantially constant even if the load varies.

In this case, in fact, the contribution of the lifting torque on the torque Ti measured is substantially zero in so far as the laundry is completely stuck to the internal wall of the drum 4. Consequently, the torque applied corresponds to the one necessary to overcome the friction torque of the rotating unit and the inertia estimation procedure doesn't work properly.

The device described above presents the advantage of being extremely simple to produce and hence of being particularly inexpensive.

In addition, the method is able to estimate the moment of inertia of the rotating unit and the weight of the laundry B even at low speeds hence enabling a timely evaluation of the unbalancing before the sticking speed is reached. In this way, any condition of unbalancing of the washing unit that may cause collision of the washing unit with the frame is consequently conveniently eliminated.

Finally, it is clear that modifications and variations may be made to the calculation device, the method, and the washing machine described above, without thereby departing from the scope of the present invention, as defined by the annexed claims.

The invention claimed is:

1. A method for estimating the moment of inertia of a rotating unit of a washing or washing-and-drying machine; said machine comprising a frame and a washing unit connected to the frame and comprising said rotating unit, which is, in turn, provided with a drum, which is able to house laundry and is mounted within the frame so that said drum is free to rotate about an axis of rotation of its own, and with driving means designed to set said drum in rotation about said axis; said method comprising the steps of:

(a) establishing one or more linear parameters, each of which is associated with a corresponding pre-set speed of rotation of said drum, which has a value lower than a sticking-speed threshold corresponding to a minimum speed at which the laundry remains completely stuck to an internal wall of said drum so as to form a single body with the drum;

(b) rotating said drum containing the laundry in such a way as to reach at least one of said pre-set speeds of rotation;

(c) for each said pre-set speed of rotation, detecting the value of the total torque provided to the rotating unit plus the laundry contained in the drum;

(d) estimating the total moment of inertia of the rotating unit plus the laundry contained in the corresponding drum through a linear combination of said torques, detected at each said pre-set speed of rotation, and by using said linear parameters associated to the pre-set speed of rotation itself.

2. The method according to claim 1, wherein each of said linear parameters corresponds to a numeric value correlated to the moment of inertia and to the torque of the rotating unit in a condition in which the drum rotates at said pre-set speed of rotation.

3. The method according to claim 1, wherein each of said linear parameters corresponds to a numeric value correlated to the ratio between the moment of inertia and the torque of the rotating unit in a condition in which said drum rotates at said pre-set speed of rotation.

4. The method according to claim 1, wherein said linear combination for the estimation of said moments of inertia comprises total torque values at said pre-set speeds of rotation, but does not comprise the value of the speed of rotation of said drum itself.

5. The method according to claim 1, wherein said linear combination for estimating the total moment of inertia of the rotating unit plus the laundry contained in the corresponding drum comprises the following relation:

$$J_E = \sum_{i=1}^{N} K_i(\omega_i) \cdot T_i(\omega_i)$$

where $K_i(\omega_i)$ and $T_i(\omega_i)$ are, respectively, the linear parameters and the torques detected at the pre-set speeds $(\omega_i)$ of rotation.

6. The method according to claim 1, wherein said step (b) comprises the step of rotating said drum according to a substantially staircase speed profile, in which each step of the staircase corresponds to a respective pre-set speed of rotation.

7. The method according to claim 1, wherein said step (b) comprises the step of rotating said drum according to a substantially continuous ramp speed profile.

8. The method according to claim 1, comprising the step of estimating the weight of the laundry contained in said drum as a function of said moment of inertia.

9. A device for estimating the moment of inertia of a rotating unit of a washing or washing-and-drying machine; said machine comprising a frame and a washing unit connected to the frame and comprising said rotating unit, which is, in turn, provided with a drum, which is designed to house the laundry and is mounted within the frame so that said drum is free to rotate about an axis of rotation of its own, and driving means designed to set said drum in rotation about said axis; said device comprising:

a memory containing one or more linear parameters, each of which is associated with a corresponding pre-set speed of rotation of said drum having a value lower than a sticking-speed threshold corresponding to a minimum speed at which the laundry remains completely stuck to an internal wall of said drum so as to form a single body with the drum;

a control unit configured to rotate said drum containing the laundry in such a way as to reach at least one of said pre-set speeds of rotation;

a detection unit configured to detect, for each said pre-set speed of rotation, the value of the total torque provided to the rotating unit plus the laundry contained in the drum; and a calculation unit configured to implement a linear combination of said torques by using said linear parameters for estimating the total moment of inertia of the rotating unit plus the laundry contained in the corresponding drum.

10. The device according to claim 9, wherein each of said linear parameters corresponds to a numeric value correlated to the moment of inertia and to the torque of the rotating unit in a condition in which said drum rotates at said pre-set speed of rotation.

11. The device according to claim 9, wherein each of said linear parameters corresponds to a numeric value correlated to the ratio between the moment of inertia and the torque of the rotating unit in a condition in which said drum rotates at said pre-set speed of rotation.

12. The device according to claim 9, wherein said linear combination for the calculation of said moment of inertia comprises total torque values at said pre-set speeds of rotation, but does not comprise the value of the speed of rotation of said drum itself.

13. The device according to claim 9, wherein said linear combination for estimating the total moment of inertia of the rotating unit plus the laundry contained in the corresponding drum comprises the following relation:

$$J_E = \sum_{i=1}^{N} K_i(\omega_i) \cdot T_i(\omega_i)$$

where $K_i(\omega_i)$ and $T_i(\omega_i)$ are, respectively, the linear parameters and the torques detected at the pre-set speeds $(\omega_i)$ of rotation.

14. The device according to claim 9, wherein said control unit is configured to control rotation of said drum according to a substantially staircase speed profile, in which each step of the staircase corresponds to a respective pre-set speed of rotation.

15. The device according to claim 9, wherein said control unit is configured to control rotation of said drum according to a substantially continuous ramp speed profile.

16. The device according to claim 9, comprising an estimation unit configured to estimate the weight of the laundry contained in said drum as a function of the moment of inertia.

17. A computer readable data storage medium containing instructions loadable into a memory of electronic computing means and designed to implement, when executed by said computing means, a method comprising the steps of:

establishing one or more linear parameters, each of which is associated with a corresponding pre-set speed of rotation of a drum of a rotating unit of a washing or washing-and-drying machine, said drum having a value lower than a sticking-speed threshold corresponding to a minimum speed at which laundry remains completely stuck to an internal wall of said drum so as to form a single body with the drum;

rotating said drum containing the laundry in such a way as to reach at least one of said pre-set speeds of rotation;

for each said pre-set speed of rotation, detecting the value of the total torque provided to the rotating unit plus the laundry contained in the drum; and estimating total moment of inertia of the rotating unit plus the laundry contained in the corresponding drum through a linear combination of said torques, detected at each said pre-set speed of rotation, and by using said linear parameters associated to the pre-set speed of rotation itself.

18. A washing or washing-and-drying machine comprising a frame and a washing unit connected to the frame and comprising a rotating unit, which is, in turn, provided with a drum which is designed to house laundry and is mounted within the frame so that said drum is free to rotate about an axis of rotation of its own, and driving means designed to set said drum in rotation about said axis; said machine comprising a device for estimating the moment of inertia of said rotating unit; said device comprising:

a memory containing one or more linear parameters, each of which is associated to a corresponding pre-set speed of rotation of said drum having a value lower than a sticking-speed threshold corresponding to a minimum speed at which the laundry remains completely stuck to an internal wall of said drum so as to form a single body with the drum;

a control unit configured to rotate said drum containing the laundry in such a way as to reach at least one of said pre-set speeds of rotation;

a detection unit configured to detect, for each said pre-set speed of rotation, the value of the total torque provided to the rotating unit plus the laundry contained in the drum; and a calculation unit configured to implement a linear combination of said torques by using the said linear parameters for estimating the total moment of inertia of the rotating unit plus the laundry contained in the corresponding drum.

19. A machine according to claim 18, wherein each of said linear parameters corresponds to a numeric value correlated to the moment of inertia and to the torque of the rotating unit in a condition in which said drum rotates at said pre-set speed of rotation.

20. A machine according to claim 18, wherein each of said linear parameters corresponds to a numeric value correlated to the ratio between the moment of inertia and the torque of the rotating unit in a condition in which said drum rotates at said pre-set speed of rotation.

21. A machine according to claim 18, wherein said linear combination for the calculation of said moments of inertia comprises total torque values at said pre-set speeds of rotation, but does not comprise the value of the speed of rotation of said drum itself.

22. A machine according to claim 18, wherein said linear combination for estimating the total moment of inertia of the rotating unit plus the laundry contained in the corresponding drum comprises the following relation:

$$J_E = \sum_{i=1}^{N} K_i(\omega_i) \cdot T_i(\omega_i)$$

where $K_i(\omega_i)$ and $T_i(\omega_i)$ are, respectively, the linear parameters and the torques detected at the pre-set speeds $(\omega_i)$ of rotation.

23. A machine according to claim 18, wherein said control unit is configured to control rotation of said drum according to a substantially staircase speed profile, in which each step of the staircase corresponds to a respective pre-set speed of rotation.

24. A machine according to claim 18, wherein said control unit is configured to control rotation of said drum according to a substantially continuous ramp speed profile.

25. A machine according to claim 18, wherein said device comprises an estimation unit configured to estimate the weight of the laundry contained in said drum as a function of the moment of inertia.

* * * * *